US010096409B2

(12) United States Patent
Matsumoto

(10) Patent No.: US 10,096,409 B2
(45) Date of Patent: Oct. 9, 2018

(54) CHIP RESISTOR AND METHOD FOR MANUFACTURING SAME

(71) Applicant: KOA Corporation, Ina-shi, Nagano (JP)

(72) Inventor: Kentaro Matsumoto, Ina (JP)

(73) Assignee: KOA Corporation, Ina-shi (JP)

( * ) Notice: Subject to any disclaimer, the term of this patent is extended or adjusted under 35 U.S.C. 154(b) by 0 days.

(21) Appl. No.: 15/565,704

(22) PCT Filed: Apr. 7, 2016

(86) PCT No.: PCT/JP2016/061439
§ 371 (c)(1),
(2) Date: Oct. 11, 2017

(87) PCT Pub. No.: WO2016/167182
PCT Pub. Date: Oct. 20, 2016

(65) Prior Publication Data

US 2018/0075954 A1 Mar. 15, 2018

(30) Foreign Application Priority Data

Apr. 15, 2015 (JP) ..... 2015-083499

(51) Int. Cl.
*H01C 7/10* (2006.01)
*H01C 17/00* (2006.01)
(Continued)

(52) U.S. Cl.
CPC ..... *H01C 17/006* (2013.01); *H01C 1/142* (2013.01); *H01C 17/12* (2013.01); *H01C 17/28* (2013.01)

(58) Field of Classification Search
CPC ..... H01C 17/006; H01C 17/12; H01C 17/28; H01C 1/142
(Continued)

(56) References Cited

U.S. PATENT DOCUMENTS 6,943,662 B2 * 9/2005 Tanimura ..... H01C 1/142 257/537
7,782,173 B2 * 8/2010 Urano ..... H01C 1/012 338/307
(Continued)

FOREIGN PATENT DOCUMENTS

JP 10-275702 A 10/1998
JP 2001-185401 A 7/2001
(Continued)

OTHER PUBLICATIONS

JP 10-275702, Tanaka et al., Oct. 1998. Machine translation.*
(Continued)

*Primary Examiner* — Kyung Lee
(74) *Attorney, Agent, or Firm* — Crowell & Moring LLP

(57) ABSTRACT

Provided is a chip resistor having wide and flat end-face electrodes on a surface thereof and having increased connection reliability between upper electrodes and the end-face electrodes. The chip resistor according to the present invention is provided with: a cuboidal insulating substrate 1; a pair of upper electrodes 2 disposed at both ends in a longitudinal direction on a surface of the insulating substrate 1; a resistor body 3 disposed between the upper electrodes 2; an insulating protective layer 4 covering the entire surfaces of the upper electrodes 2 and the resistor body 3; and a pair of end-face electrodes 5 disposed on both end faces in the longitudinal direction of the insulating substrate 1, wherein the upper electrodes 2 include bent portions 2*a* extending around from between the insulating substrate 1 and the protective layer 4 along the end faces of the protective layer 4, and the end-face electrodes 5 are connected to the exposed portions of the upper electrodes 2, including the bent portions 2*a*, exposed from between the insulating substrate 1 and the protective layer 4.

5 Claims, 4 Drawing Sheets

(51) Int. Cl.
*H01C 1/142* (2006.01)
*H01C 17/12* (2006.01)
*H01C 17/28* (2006.01)

(58) Field of Classification Search
USPC ..... 338/22 R
See application file for complete search history.

(56) References Cited

U.S. PATENT DOCUMENTS 8,354,912 B2 * 1/2013 Yoneda ..... H01C 1/148 338/22 R
2005/0200451 A1 * 9/2005 Tsukada ..... H01C 7/06 338/309
2006/0197648 A1 * 9/2006 Smith ..... H01C 1/084 338/309
2007/0132545 A1 * 6/2007 Tsukada ..... H01C 1/144 338/309
2009/0108986 A1 * 4/2009 Urano ..... H01C 1/012 338/309
2010/0117783 A1 * 5/2010 Tanimura ..... H01C 1/148 338/204
2014/0049358 A1 * 2/2014 Kim ..... H01C 7/00 338/309
2016/0247610 A1 * 8/2016 Shinoura ..... H01C 1/142
2017/0271053 A1 * 9/2017 Yoneda ..... H01C 1/012

FOREIGN PATENT DOCUMENTS

JP 2003-142304 A 5/2003
JP 2005-268302 A 9/2005
JP 2011-91140 A 5/2011

OTHER PUBLICATIONS

International Search Report (PCT/ISA/210) issued in PCT Application No. PCT/JP2016/061439 dated Jun. 21, 2016 with English translation (Four (4) pages).
Japanese-language Written Opinion (PCT/ISA/237) issued in PCT Application No. PCT/JP2016/061439 dated Jun. 21, 2016 (Three (3) pages).

* cited by examiner

CHIP RESISTOR AND METHOD FOR MANUFACTURING SAME

TECHNICAL FIELD

The present invention relates to a chip resistor which is suitable for being used as aboard inner layer type component, and a method for manufacturing such chip resistors.

BACKGROUND ART

Generally, a chip resistor is mainly constituted by an insulating substrate, a pair of front electrodes, a resistor body, an insulating protection layer, a pair of back electrodes, a pair of end-surface electrodes, etc. The insulating substrate is shaped like a cuboid. The pair of front electrodes are provided on lengthwise opposite edge portions of a front surface of the insulating substrate. The resistor body is provided between the two front electrodes. The insulating protection layer covers the resistor body. The pair of back electrodes are provided on lengthwise opposite edge portions of a back surface of the insulating substrate. Through the pair of end-surface electrodes, the front electrodes and the back electrodes are electrically conductively connected to each other respectively. Trimming is applied to the resistor body in order to adjust a resistance value thereof.

Recently, as the size and weight of an electronic device are reduced or the configuration of a circuit is complicated, there has arisen a case in which such a chip resistor is not only used in a surface-mounted manner on a circuit board but is also used as an inner layer type chip resistor embedded inside a resin layer of a laminate circuit board etc. In this case, a wiring pattern in a front surface of the resin layer is connected to the chip resistor inside the resin layer through via holes. Therefore, it is desirable that front surfaces of the end-surface electrodes connected to the via holes are wide and flat. A chip resistor configured to have wide and flat terminal electrodes in its front surface has been known as a configuration example satisfying such a demand (e.g. see Patent Literature 1).

In the configuration of the chip resistor disclosed in Patent Literature 1, the end-surface electrodes are extended from front electrodes to positions reaching an upper surface of a protection layer so that the end-surface electrodes whose front surfaces are made wide and flat can be formed. Each of the end-surface electrodes is formed to cover an overlapping portion (convex) between the corresponding front electrode and the resistor body. Therefore, there is a fear that the front surface of the end-surface electrode is not always flat but may be gently uneven.

To solve this problem, a chip resistor having the following configuration has been heretofore proposed, as described in Patent Literature 2. That is, a protection layer is formed to cover entire surfaces of front electrodes and a resistor body, and terminal electrodes are formed to extend around to a flattened upper surface of the protection layer so that front surfaces of the terminal electrodes can be flattened.

The chip resistor described in Patent Literature 2 is manufactured in the following manner. That is, a plurality of sets of front electrodes and resistor bodies corresponding to a larger number of chip resistors, and a protection layer covering entire surfaces of the front electrodes and the resistor bodies are formed sequentially on a large-sized substrate. An auxiliary protection layer made of wax etc. is formed on the protection layer. Then, first slits are formed in the large-sized substrate by dicing. End-surface terminals extending around from the insides of the first slits to an upper surface of the protection layer are formed. Then, secondary slits are formed in the large-sized substrate, and the auxiliary protection layer is cleaned and removed. Thus, single chips in each of which the end-surface electrodes are formed on the upper surface of the protection layer are manufactured.

CITATION LIST

Patent Literature

Patent Literature 1: JP-A-2011-91140
Patent Literature 2: JP-A-2005-268302

SUMMARY OF INVENTION

Technical Problem

However, when the end-surface electrodes are formed on the flattened upper surface of the protection layer as in the chip resistor described in Patent Literature 2, the end-surface electrodes can be connected only to the front electrodes exposed between an insulating substrate and the protection layer, i.e. exposed end surfaces corresponding to the thicknesses of the front electrodes. Accordingly, there occurs a problem that connection reliability between the front electrodes and the end-surface electrodes may deteriorate. Particularly when the size of the external shape of the chip resistor is reduced, it is necessary to form each of the front electrodes to have a very thin thickness. For this reason, the connection reliability between the front electrodes and the end-surface electrodes deteriorates excessively.

The present invention has been accomplished in consideration of the aforementioned actual circumstances of the background art. A first object of the present invention is to provide a chip resistor which has wide and flat end-surface electrodes in its front surface and which has high connection reliability between front electrodes and the end-surface electrodes. In addition, a second object of the present invention is to provide a method for manufacturing such chip resistors.

Solution to Problem

In order to attain the aforementioned first object, the chip resistor according to the present invention is a chip resistor including: an insulating substrate that is shaped like a cuboid; a pair of front electrodes that are provided on lengthwise opposite edge portions of a front surface of the insulating substrate; a resistor body that is disposed between the two front electrodes and connected to the two front electrodes; a protection layer that covers entire surfaces of the resistor body and the two front electrodes; and a pair of end-surface electrodes that are provided on lengthwise opposite end surfaces of the insulating substrate to be electrically conductively connected to the front electrodes. The chip resistor is configured such that the front electrodes have bent portions that extend around from between the insulating substrate and the protection layer along end surfaces of the protection layer; and the end-surface electrodes are connected to exposed portions of the front electrodes including the bent portions, that are exposed from between the insulating substrate and the protection layer.

In the chip resistor configured thus, the entire surfaces of the resistor body and the front electrodes are covered with the protection layer, and the front electrodes have the bent portions that extend around from between the insulating substrate and the protection layer along the end surfaces of the protection layer. At the same time, the end-surface electrodes are connected to the exposed portions of the front electrodes including the bent portions, that are exposed from between the insulating substrate and the protection layer. Accordingly, connection reliability between the front electrodes and the end-surface electrodes can be enhanced while the wide and flat end-surface electrodes are formed on an upper surface of the protection layer.

In the aforementioned configuration, the front electrodes are exposed from the lengthwise end surfaces and widthwise end surfaces of the insulating substrate, the bent portions are continuous to the front electrodes that are exposed from the lengthwise end surfaces and/or the widthwise end surfaces, and the end-surface electrodes extend around to the widthwise opposite end surfaces of the insulating substrate to be connected to the exposed portions of the front electrodes including the bent portions. Consequently, connection reliability between the front electrodes and the end-surface electrodes can be enhanced more greatly.

In addition, in the aforementioned configuration, the front electrodes have thick film portions in which the front electrodes are formed partially thick, and the bent portions are continuous from edge portions of the thick film portions. Consequently, connection reliability between the front electrodes and the end-surface electrodes can be enhanced more greatly.

In order to attain the aforementioned second object, the method for manufacturing the chip resistors according to the present invention is a method for manufacturing chip resistors, in which a large-sized substrate is divided along division lines arranged in a grid pattern so that chip resistors each having a resistor body and a pair of front electrodes can be obtained collectively, the method including the steps of: forming primary division grooves and secondary division grooves in the large-sized substrate, the primary division grooves and the secondary division grooves extending lengthwise and widthwise; forming pairs of front electrodes on a front surface of the large-sized substrate to be laid across the primary division grooves; forming resistor bodies connected to the pairs of the front electrodes; forming a protective layer to cover the pairs of the front electrodes and the resistor bodies; dividing the large-sized substrate along the primary division grooves to form strip-shaped substrates; rubbing the front electrodes exposed in division surfaces of the strip-shaped substrates to form bent portions on end surfaces of the protection layer; forming end-surface electrodes on the division surfaces of the strip-shaped substrates to cover the bent portions; and dividing the strip-shaped substrates along the secondary division grooves to form individual chip elements.

After the large-sized substrate is thus divided (broken) along the primary division grooves to obtain the strip-shaped substrates, the front electrodes exposed in the division surfaces of the strip-shaped substrates are rubbed. Consequently, the bent portions that extend around from the front electrodes along the end surfaces of the protection layer are formed by friction force of the rubbing. Therefore, when the end-surface electrodes are then formed on the division surfaces of the strip-shaped substrates, the end-surface electrodes are connected to the exposed portions of the front electrodes including the bent portions, that are exposed from between the insulating substrate and the protection layer. Accordingly, when the strip-shaped substrates are divided into the individual chip elements along the secondary division grooves, it is possible to obtain a large number of chip resistors in each of which connection reliability between the front electrodes and the end-surface electrodes is enhanced while the wide and flat end-surface electrodes are formed on an upper surface of the protection layer.

In addition, in order to attain the aforementioned second object, the method for manufacturing the chip resistors according to the present invention is a method for manufacturing chip resistors, in which a large-sized substrate is divided along division lines arranged in a grid pattern so that chip resistors each having a resistor body and a pair of front electrodes can be obtained collectively, the method including the steps of: forming pairs of first front electrodes on a front surface of the large-sized substrate at predetermined intervals, each of the pairs of the first front electrodes extending like a belt; forming and superimposing second front electrodes on widthwise central portions of the pairs of the first front electrodes, each of the second front electrodes extending like a belt; forming resistor bodies to dispose the resistor bodies between the pairs of the first front electrodes and connect the resistor bodies to the pairs of the first front electrodes; forming a protection layer to cover the pairs of the first front electrodes, the second front electrodes and the resistor bodies; cutting the large-sized substrate along primary division lines and secondary division lines by a dicing blade to form individual chip elements, the primary division lines extending in a lengthwise direction to pass through widthwise central portions of the second front electrodes, the secondary division lines being perpendicular to the primary division lines; and forming end-surface electrodes to extend from cutting surfaces of the chip elements along the primary division lines to portions of cutting surfaces of the chip elements along the secondary division lines.

After the front electrodes (the first front electrodes and the second front electrodes), the resistor bodies and the protection layer corresponding to a large number of chip resistors are formed thus on the large-sized substrate, the large-sized substrate is cut by the dicing blade along the primary division lines and the secondary division lines to obtain the individual chip elements. The primary division lines extend in the lengthwise direction to pass through the widthwise central portions of the second front electrodes. The secondary division lines are perpendicular to the primary division lines. Consequently, the bent portions that extend around from the edge portions of the front electrodes along the end surfaces of the protection layer are formed on the diced cutting surfaces of the chip elements. Here, the front electrodes have the thick film portions in which the second front electrodes are laminated on the first front electrodes, and the thick film portions of the front electrodes are diced along the primary division lines and the secondary division lines. Accordingly, the bent portions of the front electrodes are formed on all the cutting surfaces of the chip elements, and connection reliability between the end-surface electrodes formed to cover the bent portions and the front electrodes can be enhanced.

Advantageous Effects of Invention

According to the present invention, it is possible to provide a chip resistor which has wide and flat end-surface electrodes in its front surface and which has high connection reliability between front electrodes and the end-surface electrodes, and a method for manufacturing the chip resistors.

DESCRIPTION OF EMBODIMENTS

Figure 1:
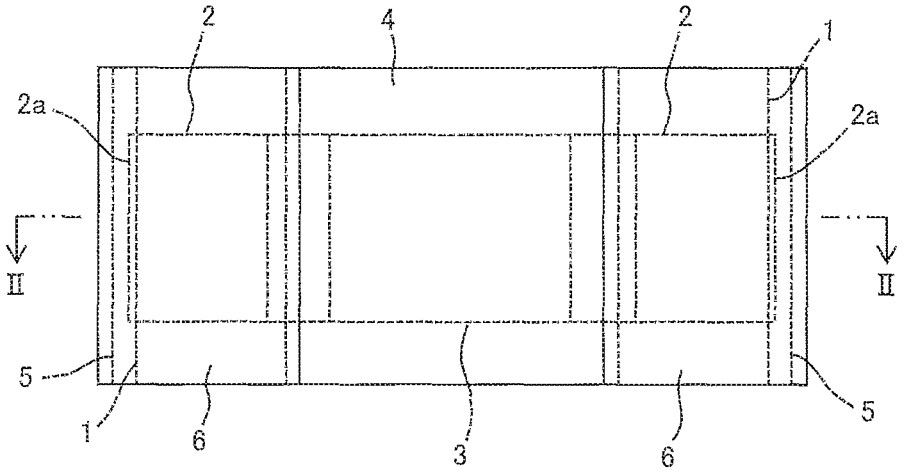
FIG. 1 A plan view of a chip resistor according to a first embodiment of the present invention.
Figure 2:
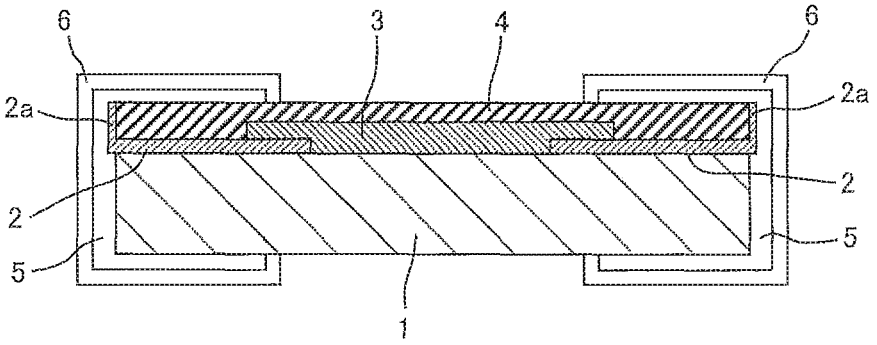
FIG. 2 A sectional view taken along a line II-II of FIG. 1.

A mode for carrying out the present invention will be described below with reference to the drawings. A chip resistor according to a first embodiment of the present invention is a board inner layer type component which is used in an embedded manner inside a resin layer of a not-shown laminate circuit board. As shown in FIG. 1 and FIG. 2, the chip resistor is mainly constituted by an insulating substrate 1, a pair of front electrodes 2, a resistor body 3, an insulating protection layer 4, a pair of end-surface electrodes 5, and a pair of external electrodes 6. The insulating substrate 1 is shaped like a cuboid. The pair of front electrodes 2 are provided on lengthwise opposite edge portions of a front surface of the insulating substrate 1. The resistor body 3 is shaped like a rectangle and provided to be connected to the front electrodes 2. The insulating protection layer 4 covers entire surfaces of the two front electrodes 2 and the resistor body 3. The pair of end-surface electrodes 5 are provided on the lengthwise opposite edge portions of the insulating substrate 1. The pair of external electrodes 6 cover the end-surface electrodes 5 respectively.

The insulating substrate 1 is made of ceramics etc. A large-sized substrate which will be described later is divided along primary division grooves and secondary division grooves which extend lengthwise and widthwise. Thus, a large number of such insulating substrates 1 are obtained.

The pair of front electrodes 2 are obtained by screen-printing, drying and sintering an Ag-based paste. Each of the front electrodes 2 is formed into a rectangular shape with a width shorter than each short side of the insulating substrate 1. Although details will be given later, the front electrode 2 has a bent portion 2*a* which extends around in an L-shape from a corresponding lengthwise end surface of the insulating substrate 1 along a corresponding end surface of the protection layer 4.

The resistor body 3 is obtained by screen-printing, drying and sintering a resistor paste of ruthenium oxide or the like. Lengthwise opposite edge portions of the resistor body 3 overlap with the front electrodes 2 respectively. Incidentally, although not shown, a trimming groove is formed in the resistor body 3 in order to adjust a resistance value thereof.

The protection layer 4 is formed to cover the entire surfaces of the two front electrodes 2 and the resistor body 3. A left end surface of the front electrode 2 positioned on a left side in FIG. 1 is exposed from between the insulating substrate 1 and the protection layer 4, and one of the bent portions 2*a* continuous to the exposed portion extends upward along the left end surface of the protection layer 4. In addition, a right end surface of the front electrode 2 positioned on a right side in FIG. 1 is exposed from between the insulating substrate 1 and the protection layer 4 and the other bent portion 2*a* continuous to the exposed portion extends upward along the right end surface of the protection layer 4.

The pair of end-surface electrodes 5 are obtained by sputtering Ni—Cu or the like or by dip-coating, drying and sintering an Ag paste or a Cu paste. Each of the end-surface terminals 5 is formed into a U-shape in section to extend from a corresponding one of the lengthwise opposite end surfaces of the insulating substrate 1 to an upper surface of the protection layer 4 and a back surface of the insulating substrate 1. Thus, the end-surface electrode 5 positioned on the left side in FIG. 1 is connected to the exposed portion of the front electrode 2 which is exposed from between the insulating substrate 1 and the protection layer 4 and the bent portion 2*a* which is formed on the left end surface of the protection layer 4, and the end-surface electrode 5 positioned on the right side in FIG. 1 is connected to the exposed portion of the front electrode 2 which is exposed from between the insulating substrate 1 and the protection layer 4 and the bent portion 2*a* which is formed on the right end surface of the protection layer 4.

The pair of external electrodes 6 are formed by electroplating front surfaces of the end-surface electrodes 5 with Ni, Sn, or the like. Each of the external electrodes 6 is formed into a U-shape in section so as to cover a corresponding one of the end-surface electrodes 5.

In the chip resistor according to the embodiment as described above, the entire surfaces of the pair of front electrodes 2 and the resistor body 3 are covered with the protection layer 4. The front electrodes 2 have the bent portions 2*a* which extend around from between the insulating substrate 1 and the protection layer 4 along the end surfaces of the protection layer 4. At the same time, the end-surface electrodes 5 are connected to the exposed portions of the front electrodes 2 including the bent portions 2*a*, which are exposed from between the insulating substrate 1 and the protection layer 4. Accordingly, connection reliability between the front electrodes 2 and the end-surface electrodes 5 can be enhanced while the wide and flat end-surface electrodes 5 are formed on the upper surface of the protection layer 4.

Next, a method for manufacturing the chip resistors configured as described above will be described with reference to FIG. 3.

Figure 3:
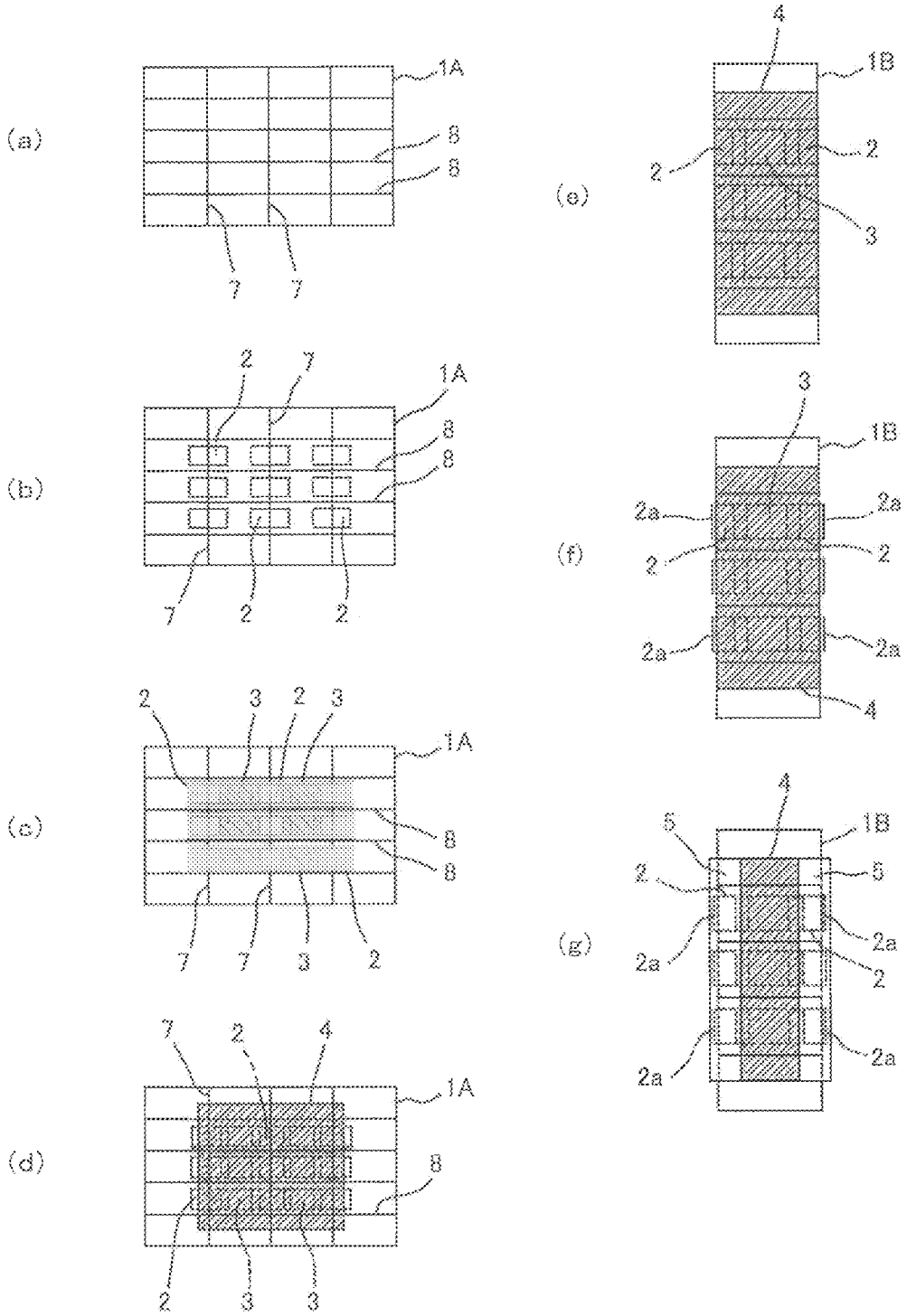
FIG. 3 Plan views showing manufacturing steps of the chip resistor.

First, a large-size substrate 1A from which a large number of insulating substrates 1 can be obtained is prepared, as shown in FIG. 3(*a*). Primary division grooves 7 and secondary division grooves 8 are provided in a grid pattern in a front surface of the large-sized substrate 1A in advance. Each of cells partitioned by the two division grooves 7 and 8 serves as a chip formation region in which one chip resistor can be formed. Incidentally, a plurality of chip formation regions in each of which one chip resistor can be formed are representatively shown in FIG. 3. However, in practice, each step which will be described below is performed collectively on the large-sized substrate 1A corresponding to a large number of chip formation regions in each of which one chip resistor can be formed.

That is, an Ag-based paste is printed, dried and sintered to be laid across the primary division grooves 7. Thus, pairs of front electrodes 2 are formed on the front surface of the large-sized substrate LA, as shown in FIG. 3(*b*). On this occasion, each of the front electrodes 2 is formed into a rectangular shape on a central portion of a region interposed between adjacent ones of the secondary division grooves 8. Accordingly, a predetermined interval is secured between each long side of the front electrode 2 and each of the secondary division grooves 8.

Next, a resistor paste of ruthenium oxide or the like screen-printed on the front surface of the large-sized substrate 1A is dried and sintered. Thus, each of resistor bodies 3 is formed on a central portion of a corresponding region interposed between adjacent ones of the primary division grooves 7, as shown in FIG. 3(*c*). On this occasion, lengthwise opposite edge portions of the resistor body 3 are connected to the corresponding front electrodes 2 paired with each other. Incidentally, a sequence of forming the front electrodes 2 and the resistor bodies 3 may be reversed to the aforementioned sequence. Specifically, after each of the resistor bodies 3 is formed on the central portion of the corresponding region interposed between the adjacent ones of the primary division grooves 7, the corresponding front electrodes 2 may be formed to be superimposed on the lengthwise opposite edge portions of the resistor body 3.

Next, as a material for reducing damage on the resistor bodies 3 during formation of trimming grooves, a glass paste is screen-printed, dried and sintered. Thus, a not-shown undercoat layer is formed to cover the resistor bodies 3. Then, the trimming grooves are formed in the resistor bodies 3 through the undercoat layer to thereby adjust resistance values of the resistor bodies 3. Thereafter, a glass paste is screen-printed, dried and sintered so as to cover the undercoat layer. In this manner, a protection layer 4 is formed to cover entire surfaces of the front electrodes 2 and the resistor bodies 3, as shown in FIG. 3(*d*).

The steps so far are processed in batch on the large-sized substrate 1A. The large-sized substrate 1A is broken (primarily divided) along the primary division grooves 7 into strips in a subsequent step. Thus, a plurality of strip-shaped substrates 1B are obtained from the large-sized substrate 1A, as shown in FIG. 3(*e*). The primary division work is performed by applying bending stress in a direction in which the front surface side of the large-sized substrate 1A can be expanded. The primary division grooves 7 are broken by the bending stress so that the groove openings can be opened. Accordingly, end surfaces of the front electrodes 2 and the protection layer 4 are exposed from broken division surfaces of each of the strip-shaped substrates 1B.

Next, when the division surfaces of the strip-shaped substrate 1B are rubbed in a plate thickness direction by buffing etc., the front electrodes 2 exposed in the division surfaces are rubbed toward the end surfaces of the protection layer 4 so that the bent portions 2*a* can be formed, as shown in FIG. 3(*f*). Incidentally, when the bent portions 2*a* of the front electrodes 2 are formed thus on the end surfaces of the protection layer 4 by the rubbing treatment, it is preferable that the front electrodes 2 are made of a material containing 70% or more of Ag and the thickness of each of the front electrodes 2 is set at 3 μm to 20 μm.

Next, Ni—Cu is sputtered on the entire end surfaces of the strip-shaped substrate 1B or an Ag paste or a Cu paste dip-coated on the end surfaces of the strip-shaped substrate 1B is dried and sintered. Thus, end-surface electrodes 5 each shaped like a U-shape in section are formed on widthwise opposite side portions of the strip-shaped substrate 1B including the end surfaces thereof, as shown in FIG. 3(*g*). The end-surface electrodes 5 are formed to extend to a flattened upper surface of the protection layer 4 so that the exposed portions of the front electrodes 2 including the bent portions 2*a* can be covered with the end-surface electrodes 5.

Next, the strip-shaped substrate 1B is broken (secondarily divided) along the secondary division grooves 8. Thus, single chips (individual pieces) equal in size to the chip resistor are obtained. Then, the single chips which have been divided separately and individually are electroplated with Ni, Sn, or the like. Thus, external electrodes 6 are formed to cover the end-surface electrodes 5. As a result, chip resistors shown in FIG. 1 and FIG. 2 are completed.

As described above, the method for manufacturing the chip resistors according to the embodiment is performed as follows. That is, the large-sized substrate 1A is broken along the primary division grooves 7 to thereby obtain the strip-shaped substrates 1B. Then, the bent portions 2*a* extending around from the front electrodes 2 along the end surfaces of the protection layer 4 are formed by the treatment step of rubbing the front electrodes 2 exposed in the division surfaces of the strip-shaped substrates 1B. Then, the end-surface electrodes 5 are formed on the end surfaces of the strip-shaped substrates 1B. Thus, the entire exposed portions of the front electrodes 2 including the bent portions 2*a* can be connected to the end-surface electrodes 5. Accordingly, it is possible to obtain a large number of the chip resistors in which connection reliability between the end-surface electrodes 5 and the front electrodes 2 are enhanced while the wide and flat end-surface electrodes 5 are formed on the flattened upper surface of the protection layer 4.

Figure 4:
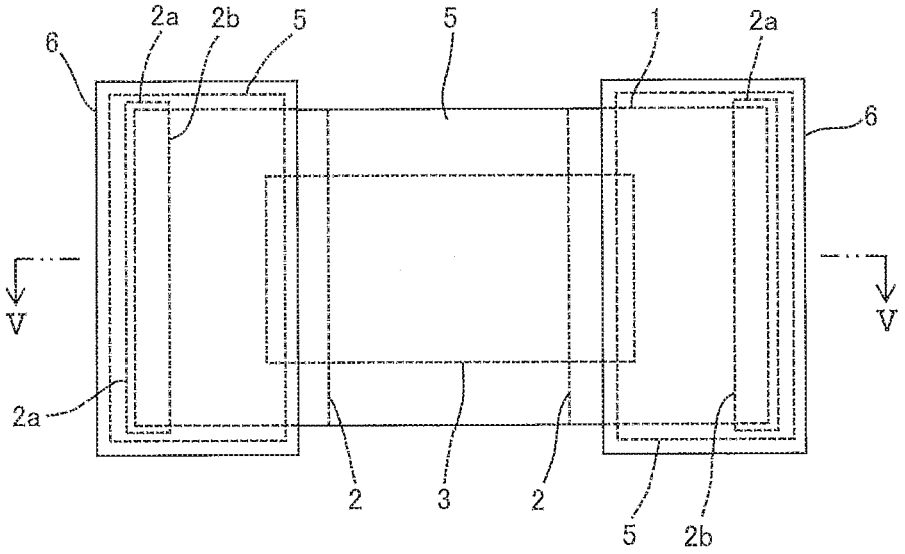
FIG. 4 A plan view of a chip resistor according to a second embodiment of the present invention.
Figure 5:
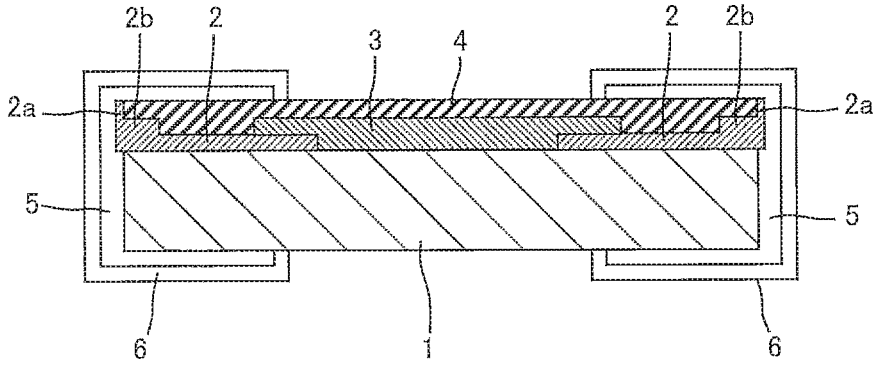
FIG. 5 A sectional view taken along a line V-V of FIG. 4.

FIG. 4 is a plan view of a chip resistor according to a second embodiment of the present invention. FIG. 5 is a sectional view taken along a line V-V of FIG. 4. In FIG. 4 and FIG. 5, portions corresponding to those in FIG. 1 and FIG. 2 are referred to by the same signs respectively.

In the chip resistor according to the second embodiment as shown in FIG. 4 and FIG. 5, a pair of front electrodes 2 are exposed from lengthwise end surfaces and widthwise end surfaces of an insulating substrate 1. Edge portions of the front electrodes 2 thicker than the other portions of the front electrodes 2 are formed as thick film portions 2B each having a two-layer structure. End-surface electrodes 5 are made to extend around to the widthwise opposite end surfaces of the insulating substrate 1 so that the end-surface electrodes 5 can be connected to the exposed portions of the front electrodes 2. Each of the front electrodes 2 has a bent portion 2*a* which extends around in an L-shape from the exposed portions of the thick film portion 2*b* along corresponding end surfaces of a protection layer 4. As will be described later, the bent portions 2*a* are formed when a large-sized substrate is diced along primary division lines and secondary division lines. Incidentally, as for the other configuration, the chip resistor according to the second embodiment is basically the same as the chip resistor according to the first embodiment. Duplicated description thereof will be therefore omitted herein.

In the chip resistor according to the second embodiment as described above, the front electrodes 2 covered with the protection layer 4 are exposed from the widthwise end surfaces and the lengthwise end surfaces of the insulating substrate 1, and the end-surface electrodes 5 extend around not only to the lengthwise end surfaces of the insulating substrate 1 but also to the widthwise end surfaces of the insulating substrate 1 so that the end-surface electrodes 5 can be connected to the exposed portions of the front electrodes 2. Accordingly, connection reliability between the front electrodes 2 and the end-surface electrodes 5 can be enhanced while the wide and flat end-surface electrodes 5 are formed on an upper surface of the protection layer 4. Moreover, the edge portions of the front electrodes 2 serve as the thick film portions 2*b* to be thicker than the other portions of the front electrodes 2. The bent portions 2*a* continuous to the thick film portions 2*b* are covered with the end-surface electrodes 5 to be thereby connected thereto. Accordingly, connection reliability between the front electrodes 2 and the end-surface electrodes 5 can be enhanced more greatly.

Next, a method for manufacturing the chip resistors configured as described above will be described with reference to FIG. 6.

Figure 6:
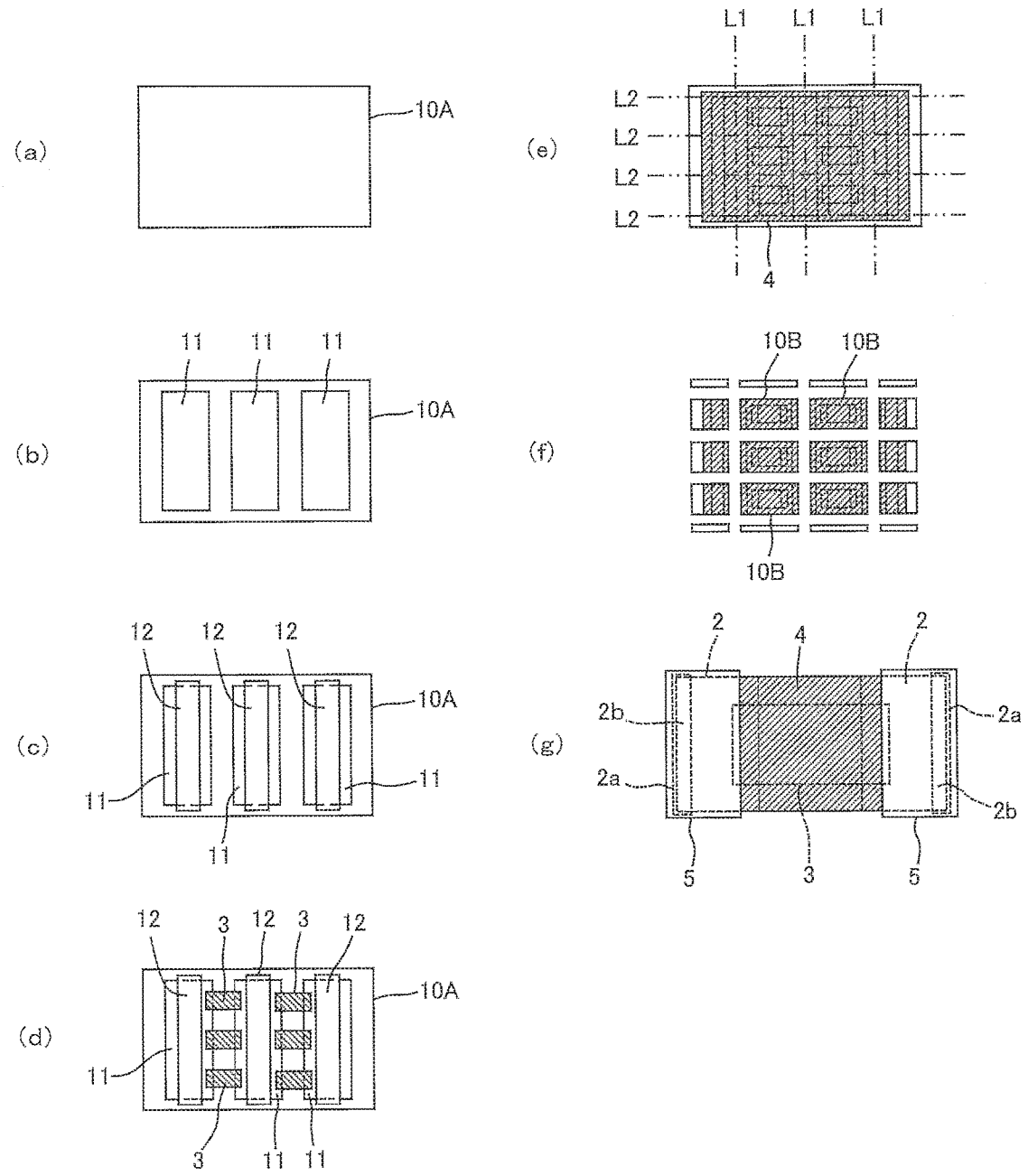
FIG. 6 Plan views showing manufacturing steps of the chip resistor.

First, as shown in FIG. 6(*a*), a large-sized substrate 10A in which primary division grooves and secondary division grooves are not formed is prepared, and an Ag paste screen-printed on a front surface of the large-sized substrate 10A is dried and sintered. Thus, pairs of first front electrodes 11 each extending like a belt are formed at predetermined intervals on the front surface of the large-sized substrate 10A, as shown in FIG. 6(*b*).

Next, the Ag paste printed on the pairs of first front electrodes 11 is dried and sintered. Thus, second front electrodes 12 each shaped like a belt are formed to be superimposed on widthwise central portions of the first front electrodes 11, as shown in FIG. 6(*c*).

Next, a resistor paste of ruthenium oxide or the like screen-printed on the front surface of the large-sized substrate 10A is dried and sintered. Thus, a plurality of resistor bodies 3 are formed to be laid between the paired first front electrodes 11, as shown in FIG. 6(*d*).

Next, as a material for reducing damage on the resistor bodies 3 during formation of trimming grooves, a glass paste is screen-printed, dried and sintered. Thus, an undercoat layer is formed to cover the resistor bodies 3. Then, the trimming grooves are formed in the resistor bodies 3 through the undercoat layer so as to adjust resistance values of the resistor bodies 3. Incidentally, the second front electrodes 12 may be formed of resin silver. In this case, since sintering temperature of the resistor paste is considerably higher than melting temperature of the resin silver, the second front electrodes 12 may be formed of the resin silver after the resistor bodies 3 are formed. Thereafter, an epoxy resin-based paste is screen-printed and thermally cured so as to cover the undercoat layer. Thus, a protection layer 4 is formed to cover entire surfaces of the first and second front electrodes 11 and 12 and the resistor bodies 3, as shown in FIG. 6(*e*).

Then, the large-sized substrate 10A is cut by a dicing blade along primary division lines L1 and secondary division lines L2. The primary division lines L1 extend in a lengthwise direction to pass through the widthwise central portions of the second front electrodes 12. The secondary division lines L2 are perpendicular to the primary division lines L1. Thus, individual chip elements 10B each of which is made to have the same external shape as the chip resistor are obtained, as shown in FIG. 6(*f*). Incidentally, the primary division lines L1 and the secondary division lines L2 are virtual lines set for the large-sized substrate 10A. As described above, primary division grooves and secondary division grooves corresponding to the division lines are not formed in the large-sized substrate 10A.

By such dicing, the first front electrodes 11 and the second front electrodes 12 each of which extends like a belt and which are formed into two-layer structures are cut into rectangular shapes in plain view to serve as front electrodes 2. Thus, a pair of the front electrodes 2 using their edge portions as thick film portions 2*b* of the two-layer structures are formed in lengthwise opposite edge portions of each chip element 10B. Here, each of the thick film portions 2*b* corresponds to an overlapping portion between the corresponding first front electrode 11 and the corresponding second front electrode 12. When the overlapping portions are diced, end surfaces of the thick film portions 2*b* are exposed in cutting surfaces of the chip element 10B. Therefore, the end surfaces of the thick film portions 2*b* are rubbed by shearing force of the dicing so that bent portions 2*a* can be formed. Accordingly, when the large-sized substrate 10A is diced into the shapes of the chip elements 10B along the primary division lines L1 and the secondary division lines L2, the end surfaces of the thick film portions 2*b* are exposed from all the four cutting surfaces of each of the chip elements 10B so that the bent portions 2*a* extending around from the thick film portions 2*b* along end surfaces of the protection layer 4 can be formed. Incidentally, when the large-sized substrate 10A is diced along the secondary division lines L2, not only the overlapping portions between the first front electrodes 11 and the second front electrodes 12 but also single-layer portions of only the first front electrodes 11 are cut simultaneously. Accordingly, the bent portions are also formed at the single-layer portions. However, due to the thick film portions 2*b* each formed into the two-layer structure, the bent portions 2*a* can be formed more stably.

Next, an Ag paste or a Cu paste containing a resin is dip-coated onto the end surfaces of the chip elements 10B and thermally cured. Thus, end-surface electrodes 5 extending around from the lengthwise opposite end surfaces of the chip elements 10B to predetermined positions of the widthwise opposite end surfaces of the chip elements 10B are formed, as shown in FIG. 6(*g*). The end-surface electrodes 5 are formed to extend to a flattened upper surface of the protection layer 4. The end surfaces of the front electrodes 2 exposed from the cutting surfaces of the chip elements 10B and the bent portions 2*a* continuous to the thick film portions 2*b* are covered with the end-surface electrodes 5. Then, each of the chip elements 10B is electroplated with Ni, Sn, or the like. Thus, external electrodes 6 covering the end-surface electrodes 5 are formed. As a result, chip resistors shown in FIG. 4 and FIG. 5 are completed.

As described above, the method for manufacturing the chip resistors according to the embodiment is performed as follows. That is, the first and second front electrodes 11 and 12 of the two-layer structures, the resistor bodies 3 and the protection layer 4 are formed sequentially on the large-sized substrate 10A. When the large-sized substrate 10A is then diced along the primary division lines L1 and the secondary division lines L2 to obtain the chip elements 10B, the bent portions 2*a* extending around from the edge portions of the front electrodes 2 along the end surfaces of the protection layer 4 are formed in the diced cutting surfaces of the chip elements 10B. On this occasion, the front electrodes 2 have the thick film portions 2*b* of the laminate structures in each of which the second front electrode 12 is superimposed on the first front electrode 11, and the thick film portions 2*b* are diced along the primary division lines L1 and the secondary division lines L2. Accordingly, the bent portions 2*a* of the front electrodes 2 can be formed in all the cutting surfaces of the chip elements 10B so that connection reliability between the end-surface electrodes 5 formed to cover the bent portions 2*a* and the front electrodes 2 can be enhanced. Accordingly, it is possible to obtain a large number of the chip resistors in which connection reliability between the end-surface electrodes 5 and the front electrodes 2 is enhanced while the wide and flat end-surface electrodes 5 are formed on the flattened upper surface of the protection layer 4.

In addition, although a chip resistor in which electrodes are absent from a back surface of the insulating substrate has been described in each of the aforementioned embodiments, a pair of back electrodes may be formed on lengthwise edge portions of the back surface of the insulating substrate and end-surface electrodes may be connected to both the front electrodes and the back electrodes. In this manner, the chip resistor can be connected not only to a wiring pattern on the front surface side of a resin layer but also to a wiring pattern on the back surface side of the resin layer when the chip resistor is embedded inside the resin layer of a laminate circuit board.

REFERENCE SIGNS LIST

1 insulating substrate
1A, 10A large-sized substrate
1B strip-shaped substrate
10B chip element
2 front electrode
2*a* bent portion
2*b* thick film portion
3 resistor body
4 protection layer
5 end-surface electrode
6 external electrode
7 primary division groove
8 secondary division groove
11 first front electrode
12 second front electrode
L1 primary division line
L2 secondary division line

The invention claimed is:

1. A chip resistor comprising:

an insulating substrate that is shaped like a cuboid;

a pair of front electrodes that are provided on lengthwise opposite edge portions of a front surface of the insulating substrate;

a resistor body that is disposed between the two front electrodes and connected to the two front electrodes;

a protection layer that covers entire surfaces of the resistor body and the two front electrodes; and a pair of end-surface electrodes that are provided on lengthwise opposite end surfaces of the insulating substrate to be electrically conductively connected to the front electrodes; wherein:

the front electrodes have bent portions that extend around from between the insulating substrate and the protection layer along end surfaces of the protection layer; and the end-surface electrodes are connected to exposed portions of the front electrodes including the bent portions, that are exposed from between the insulating substrate and the protection layer.

2. A chip resistor according to claim 1, wherein:

the front electrodes are exposed from the lengthwise end surfaces and widthwise end surfaces of the insulating substrate, the bent portions are continuous to the front electrodes that are exposed from the lengthwise end surfaces and/or the widthwise end surfaces, and the end-surface electrodes extend around to the widthwise opposite end surfaces of the insulating substrate to be connected to the exposed portions of the front electrodes including the bent portions.

3. A chip resistor according to claim 2, wherein:

the front electrodes have thick film portions in which the front electrodes are formed partially thick, and the bent portions are continuous from edge portions of the thick film portions.

4. A chip resistor according to claim 1, wherein:

the front electrodes have thick film portions in which the front electrodes are formed partially thick, and the bent portions are continuous from edge portions of the thick film portions.

5. A method for manufacturing chip resistors, in which a large-sized substrate is divided along division lines arranged in a grid pattern so that chip resistors each having a resistor body and a pair of front electrodes can be obtained collectively, the method comprising the steps of:

forming primary division grooves and secondary division grooves in the large-sized substrate, the primary division grooves and the secondary division grooves extending lengthwise and widthwise;

forming pairs of front electrodes on a front surface of the large-sized substrate to be laid across the primary division grooves;

forming resistor bodies connected to the pairs of the front electrodes;

forming a protective layer to cover the pairs of the front electrodes and the resistor bodies;

dividing the large-sized substrate along the primary division grooves to form strip-shaped substrates;

rubbing the front electrodes exposed in division surfaces of the strip-shaped substrates to form bent portions on end surfaces of the protection layer;

forming end-surface electrodes on the division surfaces of the strip-shaped substrates to cover the bent portions; and dividing the strip-shaped substrates along the secondary division grooves to form individual chip elements.

* * * * *